United States Patent [19]

Sakamoto et al.

[11] Patent Number: 4,583,378

[45] Date of Patent: Apr. 22, 1986

[54] REFRIGERATOR

[75] Inventors: Noriaki Sakamoto; Shinji Hirai, both of Oosaka, Japan

[73] Assignee: Kabushiki Kaisha Toshiba, Kawasaki, Japan

[21] Appl. No.: 708,942

[22] Filed: Mar. 6, 1985

[30] Foreign Application Priority Data

Mar. 14, 1984 [JP] Japan ..... 59-36235[U]

[51] Int. Cl.[4] ..... F25B 31/00

[52] U.S. Cl. ..... 62/505; 62/119

[58] Field of Search ..... 62/119, 505

[56] References Cited

U.S. PATENT DOCUMENTS 4,485,639 12/1984 Sakamoto ..... 62/119 X

*Primary Examiner*—Lloyd L. King

*Attorney, Agent, or Firm*—Cushman, Darby & Cushman

[57] ABSTRACT

A refrigerator has a main body. A compressor is provided in the bottom portion of the body, and a receiving box for housing electric appliances is arranged in the body above the compressor. A thermosiphon for conveying the heat from the compressor to the receiving box is provided in the body. The thermosiphon includes a heat receiving portion located in the vicinity of the compressor, an upper portion located in the vicinity of the receiving box, an advancing path extending from the heat receiving portion to the upper portion, and a returning path extending from the upper portion to the heat receiving portion. The upper portion is adhered to the body by a tape of aluminum foil, thereby having heat radiation efficiency higher than that of the advancing portion.

5 Claims, 6 Drawing Figures

REFRIGERATOR

BACKGROUND OF THE INVENTION

The present invention relates to a refrigerator, and more particularly, to a refrigerator comprising a thermosiphon for conveying the heat generated by a compressor to the upper region of the refrigerator.

In recent years, there has been proposed a refrigerator which comprises a thermosiphon formed by sealing an operating liquid into a closed-loop pipe. According to this kind of refrigerator, the thermosiphon conveys the heat generated by a compressor disposed on the bottom of the refrigerator to the upper region of the refrigerator. The heat conveyed is utilized to heat, e.g., an electric appliance receiving box disposed at the upper portion of the rear wall of the refrigerator body, thereby preventing electric appliances from malfunctioning due to waterdrops and cooling the compressor at the same time. Generally, the whole of the pipe which forms the thermosiphon is secured to the rear wall of the refrigerator body by means of an adhesive tape of aluminum foil, for example, and is arranged vertically along the rear wall. The thermosiphon receives the heat generated by the compressor at the lower most portion thereof to produce bubbles in the pipe. Because of the pumping function achieved by the bubbles, the operating fluid is allowed to circulate in the pipe.

However, the refrigerator having the above structure sometimes fails to sufficiently heat the electric appliance receiving box if the ambient temperature is comparatively low. In this case, waterdrops are caused by the cooled air in the refrigerator, and they inevitably attach on the surface of the electric appliances such as a coolant flow control valve and leads. The inventors of the present invention looked into the reason why waterdrops are collected on the electric appliances when the ambient temperature of the refrigerator is comparatively low. As a result, they found the following reason: When the ambient temperature of the refrigerator is low, the temperature of the compressor does not become very high, and accordingly, the number of bubbles generated in the pipe of the thermosiphon is small. In addition, since the advancing portion of the pipe is adhered to the rear wall of the refrigerator body by means of the aluminum foil tape, the quantity of heat radiated at the advancing portion of the pipe is large. In short, when the ambient temperature of the refrigerator is low, the operating fluid existing in the advancing portion of the pipe is cooled more than necessary. In addition, the number of bubbles generated is small. Therefore, the bubbles are liquefied and disappear in the advancing portion of the pipe. For this reason, the operating fluid cannot circulate smoothly, with the result that the quantity of heat radiated at the upper portion of the thermosiphon is small, and the electric appliance receiving box cannot be sufficiently heated.

SUMMARY OF THE INVENTION

The present invention has been made in consideration of the above circumstances and is intended to provide a refrigerator which ensures a normal circulation of the operating fluid in the thermosiphon even when the ambient temperature of the refrigerator is low, thereby permitting a desired portion of the refrigerator to be sufficiently heated and permitting the compressor to be sufficiently cooled.

To achieve the above object, according to an aspect of the present invention, there is provided a refrigerator comprising: a main body having substantially a box shape; a compressor provided on the bottom of the main body; a to-be-heated section provided to the main body and arranged above the compressor; a thermosiphon, formed by sealing an operating fluid into a closed-loop pipe and provided to the main body for conveying the heat generated from the compressor to the to-be-heated section by circulating the operation fluid with the heat generated from the compressor, the thermosiphon including a heat receiving portion located in the vicinity of the compressor and adapted to absorb the heat generated by the compressor, an upper portion located in the vicinity of the to-be-heated section, an advancing portion extending from the heat receiving portion to the upper portion, and a returning portion extending from the upper portion to the heat receiving portion; and heat radiating means for allowing the upper portion and/or the returning portion to have heat radiation efficiency higher than that of the advancing portion.

According to the refrigerator having the above structure, the thermosiphon has lower heat radiating efficiency at the advancing portion of the pipe than at the other portions of the pipe, thereby effectively preventing the bubbles flowing through the advancing portion from disappearing. Therefore, even when the ambient temperature of the refrigerator is low, normal circulation of the operating fluid in the thermosiphon is ensured, and the heat generated from the compressor can be reliably conveyed to the upper region of the refrigerator. As a result, a desired portion of the refrigerator can be heated, and the compressor can be cooled in a reliable manner.

BRIEF DESCRIPTION OF THE DRAWINGS

FIGS. 1 through 4 show a refrigerator according to one embodiment of the present invention, in which FIG. 1 is a perspective view showing the back side of the refrigerator, FIGS. 2 and 3 are sectional views taken along lines II—II and III—III of FIG. 1, respectively, FIG. 4 is a schematic view illustrating the operations of a thermosiphon.

DETAILED DESCRIPTION OF THE PREFERRED EMBODIMENTS

One embodiment of the present invention will now be described in detail with reference to the accompanying drawings.

Figure 1:
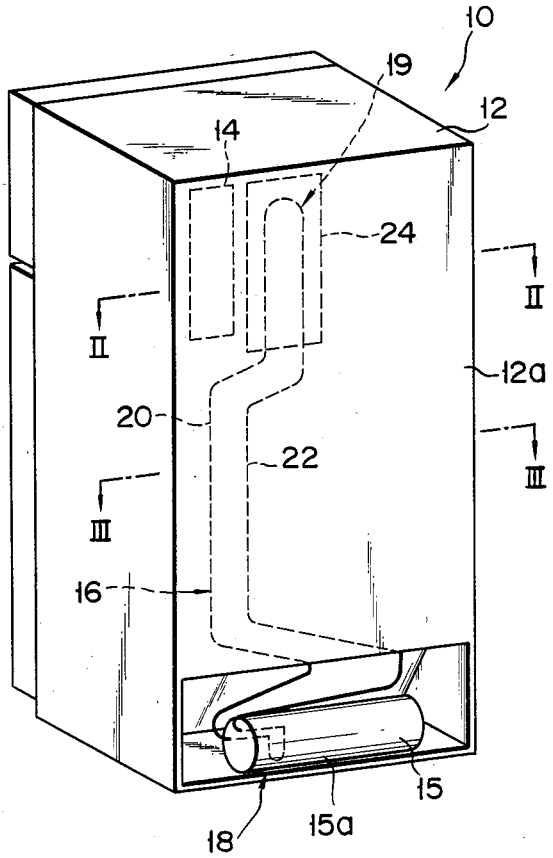
Figure 2:
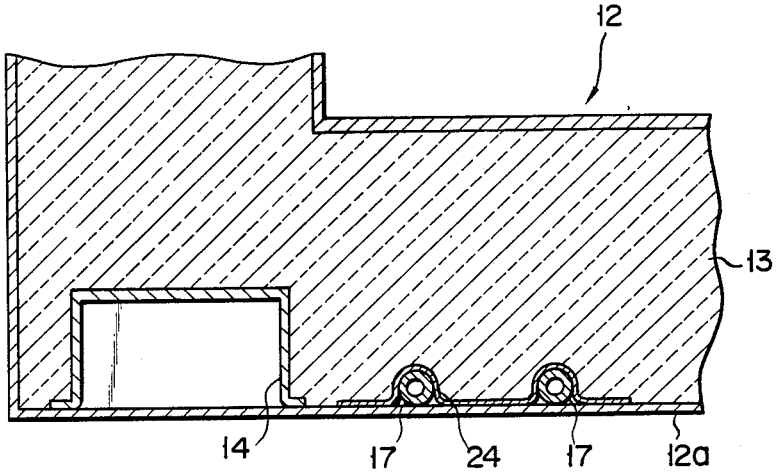

As shown in FIGS. 1 and 2, the subject refrigerator has a main body 10. This main body 10 is prepared, for example, by arranging a heat insulating material 13 in an outer box 12 made of a steel plate in such a manner as to define refrigerating and freezing chambers (not shown). A box 14 for receiving electric appliances is embedded into the heat insulating material 13 and located at the upper portion of the rear wall of the refrigerator body 10. A coolant path control valve, leads, or the like, (not shown) are disposed in the receiving box 14. A compressor 15 of, for example, the rotary type, is disposed in the bottom portion of the refrigerator body 10.

Inside the refrigerator body 10, there is provided a thermosiphon 16. This thermosiphon 16 is disposed along the rear wall 12*a* of the outer box 12. The thermosiphon 16 includes a pipe 17 in the form of a closed-loop and an operating fluid sealed in the pipe 17. The lowermost portion of the thermosiphon 16 is arranged in an outer case 15*a* of the compressor 15 and serves as a heat receiving portion 18 through which the heat generated by the compressor 15 is conducted to the thermosiphon 16. The upper portion 19 of the thermosiphon 16 is located near a section to-be-heated, namely, the electric appliance receiving box 14. That portion of the thermosiphon 16 which extends from the heat receiving portion 18 to the upper portion 19 is an advancing path 20, and that portion of the thermosiphon 16 which extends from the upper portion 19 to the heat receiving portion 18 is a returning path 22. Most of the advancing and returning paths 20 and 22 extend in the vertical direction while being in contact with the inner surface of the rear wall 12*a* of the outer box 12, as best shown in FIGS. 1 and 2.

Figure 3:
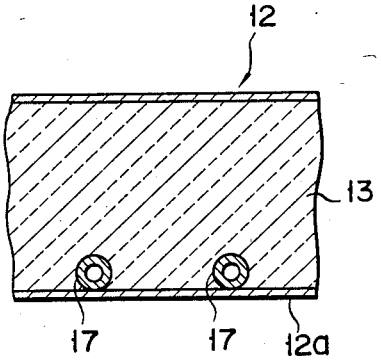

The upper portion 19 of the thermosiphon 16 is adhered to the inner surface of the rear wall 12*a* of the outer box 12 by means of an adhesive tape 24 of aluminum foil. The adhesive tape 24 serves as heat radiating means, which accelerates the heat radiation at the upper portion 19 of the thermosiphon 16 as compared with the other portions. The adhesive tape 24 is used only at the upper portion 19. Among the other portions, those in contact with the inner surface of the rear wall 12*a* of the outer box 12 are enclosed by the heat insulating material 13, as shown in FIG. 3. Therefore, the heat radiation at these portions is suppressed.

A description will now be given of the operation of the refrigerator having the above structure.

Figure 4:
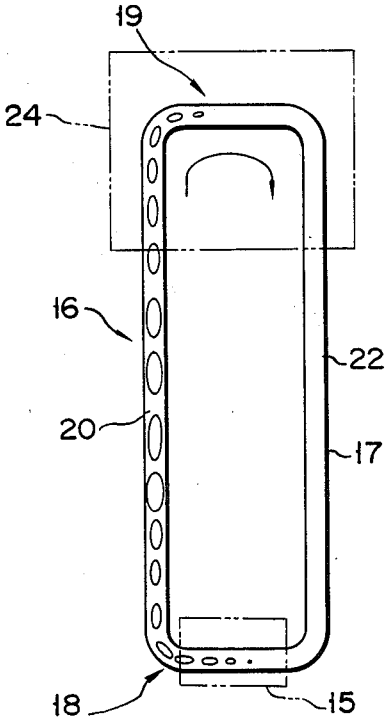

When the compressor 15 is driven to generate heat, the heat receiving portion 18 of the thermosiphon 16 is heated by the heat from the compressor. Thus, bubbles are generated in the operating fluid contained in the pipe 17, and the compressor 15 is cooled by the generation of the bubbles. As schematically shown in FIG. 4, the bubbles generated in the pipe 17 rise in the advancing path 20 of the thermosiphon 16, while upwardly pushing the operating fluid existing around them by the pumping function thereof to reach the upper portion 19. Since the heat insulating material 13 suppresses the heat radiation at the advancing path 20, the bubbles are hardly liquefied when they rise through the advancing path 20. Therefore, almost all the bubbles can reach the upper portion 19 without disappearing on the way. The bubbles which have reached the upper portion 19 are rapidly cooled and liquefied since the heat radiating means, i.e., adhesive tape 24 of aluminum foil, is provided at the upper portion 19. The operation fluid caused by the liquefaction flows down to the heat receiving portion 18 through the returning path 22 of the pipe 17. In this manner, the operating fluid circulates in the direction indicated by the arrow in FIG. 4. The vicinity of the upper portion 19 of the thermosiphon 16 is heated due to the heat radiation caused when the bubbles are liquefied at the upper portion 19. As a result, the inside of the electric appliance receiving box 14 is kept warm. Therefore, no waterdrops are produced on the coolant path control valve or leads disposed in the receiving box 14.

According to the refrigerator having the above structure, heat radiating means, i.e., the adhesive tape of aluminum foil 24, is used only at the upper portion 19 of the thermosiphon 16. Therefore, the heat radiation efficiency is higher at the upper portion 19 than at the other portions of the thermosiphon 16. For this reason, bubbles hardly disappear in the advancing path 20 of the pipe 17 even if the temperature of the compressor 15 does not rise sufficiently and the number of bubbles generated in the thermosiphon 16 is small. Accordingly, the circulation of the operating fluid in the pipe 17 is always maintained in a normal state, thus ensuring sufficient heat radiation at the upper portion 19 of the thermosiphon 16. As a result, electric appliances disposed in the receiving box 14 are kept from being affected by waterdrops, and the compressor 15 is cooled.

Figure 5:
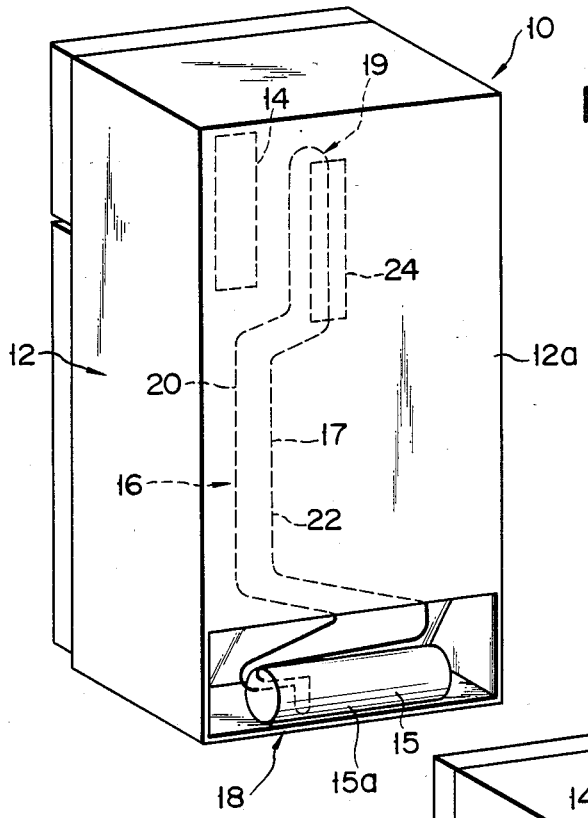
FIGS. 5 and 6 are perspective views showing refrigerators according to other embodiments of the present invention.
Figure 6:
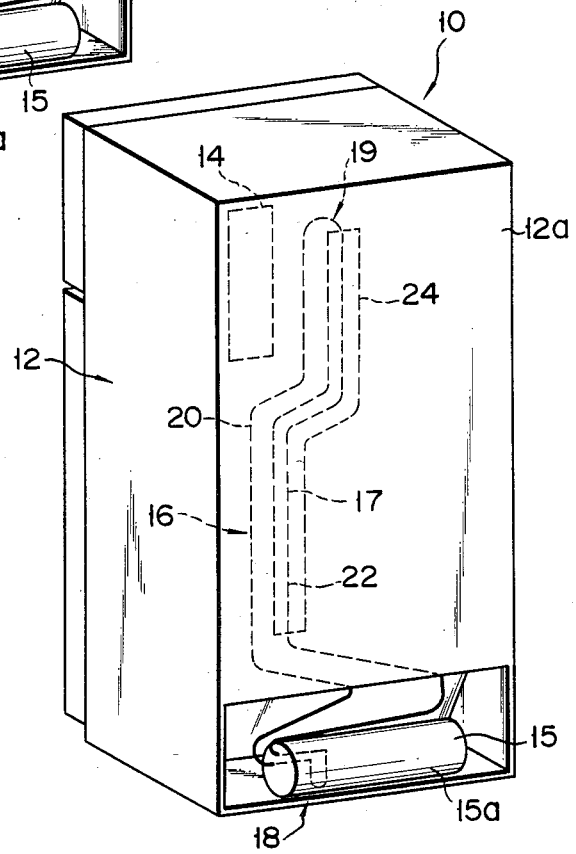

FIGS. 5 and 6 show second and third embodiments of the present invention, respectively. These embodiments differ from the above-mentioned first embodiment in the positioning of the heat radiator. In FIGS. 5 and 6, the same reference numerals are used to denote the parts corresponding to those of the first embodiment, and further explanation of them will be omitted.

In the second embodiment shown in FIG. 5, the upper portion of the returning path 22 of the thermosiphon 16 is adhered to the rear wall 12*a* of the outer box 12 by means of an adhesive tape 24 of aluminum foil. The upper portion of the returning path 22 serves as a heat radiating portion.

In the third embodiment shown in FIG. 6, substantially the whole returning path 22 of the thermosiphon 16 is adhered to the rear wall 12*a* by means of an adhesive tape 24 of aluminum foil. In this embodiment, substantially the whole returning path 22 serves as a heat radiating portion.

According to the second and third embodiments as well, it is possible to suppress the heat radiation along the advancing path 20 of the thermosiphon 16. Therefore, bubbles are prevented from disappearing when they flow through the advancing path 20. The normal circulation of the operating fluid is thus ensured, and at the same time, electric appliances are prevented from being affected by waterdrops, and the compressor 15 is cooled.

The present invention is not limited to the above-mentioned embodiments. It can be modified in various manners without departing from the scope and spirit thereof. For example, the upper portion or the returning path of the thermosiphon may be secured to a heat radiating board, although in the above-mentioned embodiments the adhesive tape of aluminum foil is used as heat radiating means. Further, the upper portion of the thermosiphon need not be located near the electric appliance receiving box. Instead, the upper portion of the thermosiphon may be located in the vicinity of a connecting pipe that allows communication between the refrigerating and freezing chambers. In this case, waterdrops are prevented from attaching on the connecting pipe.

What is claimed is:

1. A refrigerator comprising:

a main body;

a compressor arranged within the main body;

a section to-be-heated arranged above the compressor;

a thermosiphon including:

(a) an operating fluid, and (b) closed-loop pipe means, for holding said fluid and for conveying the heat generated by the compressor to the secion to-be-heated by circulating the operating fluid using the heat from the compressor, said closed loop pipe means including: (1) a heat receiving portion located in the vicinity of the compressor to maximize absorption of heat generated by the compressor, (2) an upper portion located in the vicinity of the section to-be-heated, (3) an advancing portion extending from the heat receiving portion to the upper portion, and (4) a returning portion extending from the upper portion to the heat receiving portion; and heat radiating means coupled to a portion of only the upper portion and the returning portion of the thermosiphon thus forming a heat radiating portion, said heat radiating portion having a heat radiation efficiency higher than that of the advancing portion, thereby maximizing the temperature differential between said advancing portion and said heat radiating portion.

2. A refrigerator according to claim 1, wherein said thermosiphon extends along the inner surface of the main body, and the heat radiating means includes a tape of aluminum foil by which said heat radiating portion is adhered to the inner surface of the main body.

3. A refrigerator according to claim 2, wherein said main body includes a heat insulating material disposed on the inner surface thereof, and the advancing portion of the thermosiphon is enclosed by the heat insulating material.

4. A refrigerator according to claim 1, wherein said section to-be-heated includes receiving chamber means for receiving electric appliances.

5. A refrigerator according to claim 1, wherein said compressor includes an outer case, and the heat receiving portion of the thermosiphon is disposed in the outer case.

* * * * *